US006325689B1

(12) United States Patent
Shelton et al.

(10) Patent No.: US 6,325,689 B1
(45) Date of Patent: Dec. 4, 2001

(54) SPINNING HAT PYROTECHNIC ENTERTAINMENT PRODUCT

(75) Inventors: Gregory P. Shelton, 24073 24th St., Eagleville, MO (US) 64442; Robert J. Garringer, Austin, TX (US)

(73) Assignee: Gregory P. Shelton, Eagleville, MO (US)

( * ) Notice: Subject to any disclaimer, the term of this patent is extended or adjusted under 35 U.S.C. 154(b) by 0 days.

(21) Appl. No.: 09/560,056

(22) Filed: Apr. 27, 2000

(51) Int. Cl.[7] ..... A63H 17/045
(52) U.S. Cl. ..... 446/23; 446/236; 446/22
(58) Field of Search ..... 446/72, 236, 211, 446/185, 190, 198, 199, 330, 391; 472/66; 102/355, 356, 359; F42B 4/00, 4/20

(56) References Cited

U.S. PATENT DOCUMENTS

| | | | | |
|---|---|---|---|---|
| D. 155,015 | | 8/1949 | Krapp . | |
| 370,356 | * | 9/1887 | Schuetz . | |
| 1,362,264 | | 12/1920 | Powell . | |
| 1,434,563 | | 11/1922 | Robertson . | |
| 1,554,065 | | 9/1925 | Blair . | |
| 2,241,092 | * | 5/1941 | Jurgilanis . | |
| 2,504,652 | * | 4/1950 | Cohn . | |
| 3,084,628 | | 4/1963 | Rozzi . | |
| 3,508,360 | | 4/1970 | Williams . | |
| 3,941,504 | | 3/1976 | Snarbach . | |
| 4,280,297 | * | 7/1981 | Katzman et al. . | |
| 4,480,400 | * | 11/1984 | DiDonato | 446/188 |
| 5,020,605 | * | 6/1991 | Leishman | 173/1 |
| 5,505,380 | * | 4/1996 | Jun | 239/211 |

* cited by examiner

*Primary Examiner*—D. Neal Muir
*Assistant Examiner*—Jeffrey D. Carlson
(74) *Attorney, Agent, or Firm*—Hovey, Williams, Timmons & Collins

(57) ABSTRACT

The pyrotechnic entertainment product has an upright spindle that may be pushed into the ground for support until a coil in the spindle engages the top surface of the ground. The image of an upright dancing bull or other creature is secured to the spindle intermediate its opposite ends and is poised as if he were performing the steps of a Mexican hat dance. A pyrotechnic pinwheel resembling a sombrero is rotatably carried on the upper end of the spindle slightly above the head of the bull. When the pinwheel is ignited, it propels itself about the spindle like a spinning sombrero while emitting a colorful plume of sparks reminiscent of the energy, color, and excitement of the traditional Mexican hat dance.

15 Claims, 1 Drawing Sheet

SPINNING HAT PYROTECHNIC ENTERTAINMENT PRODUCT

TECHNICAL FIELD

The present invention relates to pyrotechnic entertainment products and, more particularly, to a unique pinwheel-type product that is suggestive of the energetic spinning motions and other routines exhibited by dancers performing a dance known as the Mexican hat dance.

BACKGROUND & SUMMARY OF THE INVENTION

Pinwheel fireworks of various kinds have been available for many years. However, none has heretofore been incorporated into and formed a part of a product designed to provide a visual display when ignited that is suggestive of dancers performing the Mexican hat dance. Toward this end, the present invention contemplates a product that utilizes an upright spindle or rod that is pushed into the ground for support during use. The image of a dancing animal, such as a bull, is carried on the spindle a short distance below the upper end of the spindle. A pinwheel device configured to resemble a hat, preferably a sombrero, is carried on the upper end of the spindle just above the head of the bull such that, when ignited, the pinwheel rotates freely and gives a dazzling pyrotechnic display along with the visual effect of a spinning sombrero on the dancing bull.

DETAILED DESCRIPTION

Figure 1:
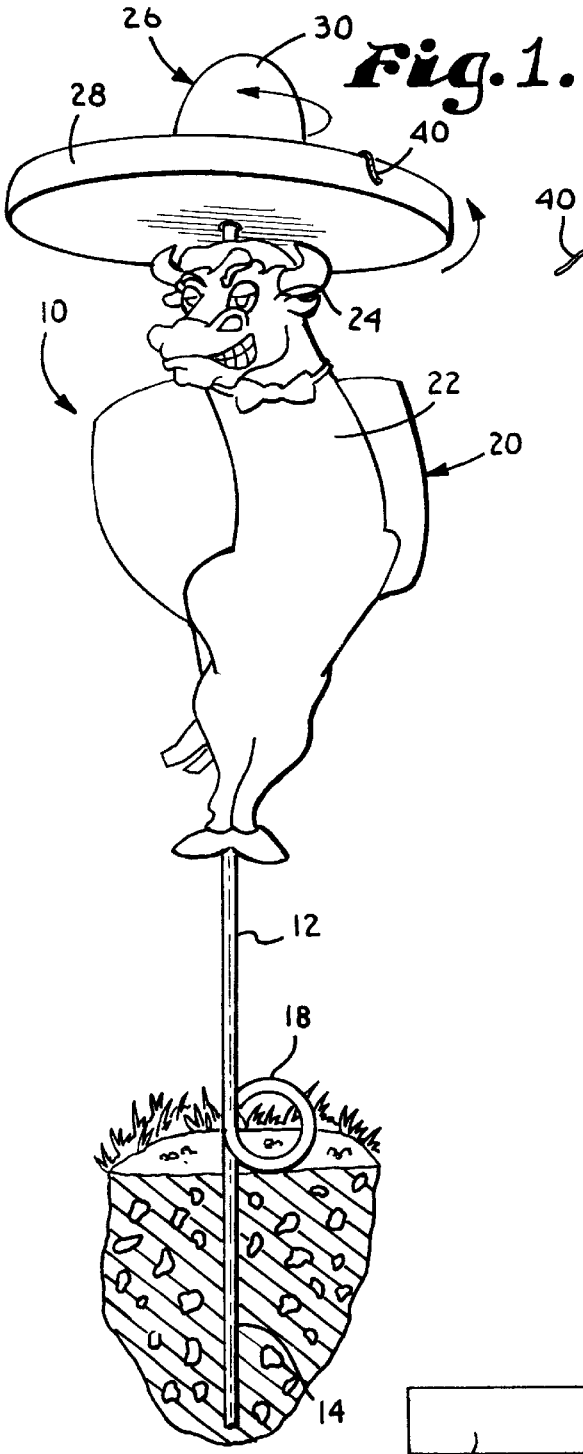
FIG. 1 front elevational view of one preferred embodiment of a pyrotechnic product constructed in accordance with the principles of the present invention, shown installed in the ground and ready for use.
Figure 2:
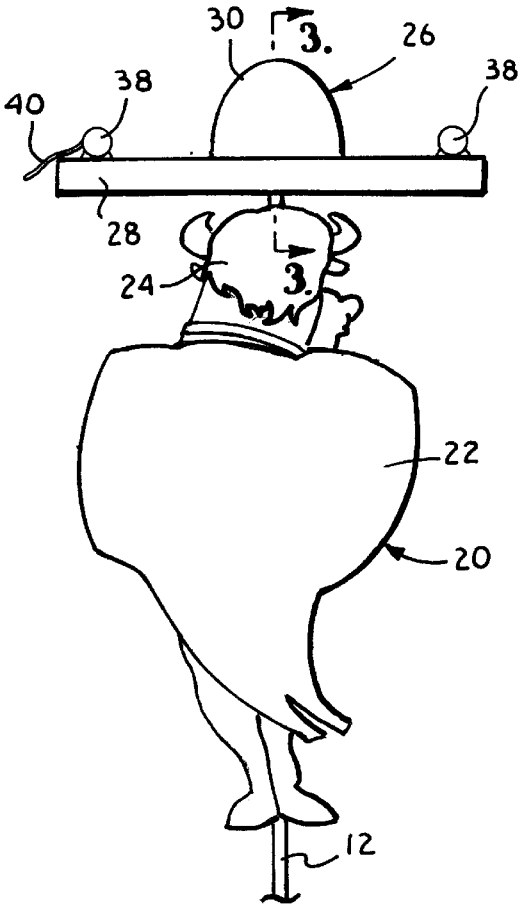
FIG. 2 is a fragmentary rear elevational view thereof.
Figure 3:
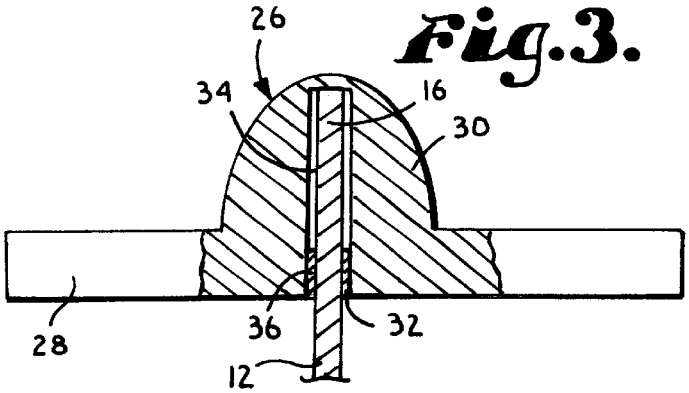
FIG. 3 is an enlarged, fragmentary elevational view of the sombrero-like pinwheel device illustrating the manner in which it is supported on the upper end of the spindle.

The pyrotechnic product 10 has a rod or spindle 12 provided with a lower end 14 (FIG. 1) and an upper end 16 (FIG. 3). Spindle 12 is slender enough that lower end 14 can be manually pushed down into the ground as shown in FIG. 1 until a coil 18 in spindle 12 engages the surface of the ground. Coil 18 thus serves as stop structure to limit the extent of penetration of spindle 12. Once spindle 12 is fully inserted into the ground, the ground supports it in an upstanding condition.

A paper article 20 having the image 22 and general configuration of an upright dancing bull or other creature thereon is secured to spindle 12 between upper and lower ends 16 and 14. The article may be constructed from a material other than paper if desired. The head 24 of the bull 22 is spaced below the upper end 16 of spindle 16. In its preferred form, the article 20 comprises two separate front and back pieces of material that are taped or otherwise securely affixed to spindle 12.

A pinwheel device 26 having the general appearance of a hat, preferably a sombrero, is rotatably carried on upper end 16 of spindle 12 a short distance above the head 24 of the bull. In its preferred form, the device 26 has a relatively wide, flat, circular panel 28 that generally resembles the brim of a sombrero, and a rounded, centrally disposed dome 30 configured to generally resemble the crown of a sombrero. A hole 32 in the center of the bottom surface of panel 28 opens to an internal bore 34 extending from panel 28 to the upper interior surface of dome 30. Hole 32 and bore 34 rotatably receive upper end 16 of spindle. A metal grommet or bushing 36 may be pressed into bore 34 adjacent hole 32 to journal the spindle 12. Upper end 16 of spindle 12 bears against the upper interior surface of dome 30 to support pinwheel 26. Preferably, the pinwheel 26 is constructed from paper material.

As well understood by those skilled in the art, pinwheel 26 includes one or more ignitable engines 38 to propel the pinwheel in a spinning motion on the spindle 12 and to release colorful, sparkling discharges while doing so. A fuse 40 may be used to ignite engines 38, which may be linked together in series if desired so that the engines fire successively rather than simultaneously, thus prolonging the visual and audible display. Pinwheel 26 spins freely on spindle 12 out of contact with head 24 of the bull 22, which remains stationary.

It will thus be appreciated that pyrotechnic product 10 provides an entertaining display that is reminiscent of the energy, color, and excitement found in the traditional Mexican hat dance. Like the dancers who circle nimbly around their sombreros, the sombrero-like pinwheel 26 circles freely atop the head of the deftly poised bull while sparks fly and colors abound.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor(s) hereby state their intent to rely on the Doctrine of Equivalents to determine and assess the reasonably fair scope of their invention as pertains to any apparatus not materially departing from but outside the literal scope of the invention as set out in the following claims.

What is claimed is:

1. A pyrotechnic entertainment product comprising:

a spindle adapted to be disposed in an upright condition during use and having an upper end and a lower end;

an article secured to the spindle between said ends and having an image thereon of a live creature, said creature having a head generally adjacent to but spaced below said upper end of the spindle; and a spinning device that is configured to resemble a hat and is rotatably mounted on the spindle, said spinning device including at least one pyrotechnic thruster disposed to propel the device in a spinning motion on the spindle whereby to produce the visual effect that the hat of the creature is spinning while the creature remains stationary.

2. A pyrotechnic entertainment product as claimed in claim 1, said article being constructed of paper.

3. A pyrotechnic entertainment product as claimed in claim 1, said creature being disposed in an upright condition as if to be dancing.

4. A pyrotechnic entertainment product as claimed in claim 3, said creature comprising a bull.

5. A pyrotechnic entertainment product as claimed in claim 4, said hat resembling a sombrero.

6. A pyrotechnic entertainment product as claimed in claim 1, said article being spaced slightly below the device to avoid physically interfering with the spinning motion of the device.

7. A pyrotechnic entertainment product as claimed in claim 1, said spindle being sufficiently slender to permit the lower end thereof to be manually forced into the ground for upstanding support thereby.

8. A pyrotechnic entertainment product as claimed in claim 2, said spindle having structure defining a stop above the lower end of the spindle but below said article to limit the extent of penetration of the lower end of the spindle into the ground.

9. A pyrotechnic entertainment product as claimed in claim 1, said device including a generally flat, circular panel resembling the brim of a hat, and a centrally disposed dome projecting upwardly from one side of the panel resembling the crown of a hat, said panel having an opening that rotatably receives the upper end of the spindle.

10. A pyrotechnic entertainment product as claimed in claim 9, said upper end of the spindle projecting into the interior of the dome and rotatably engaging an interior surface thereof to support the device during spinning movement.

11. A pyrotechnic entertainment product as claimed in claim 10, said device being constructed from paper, said panel having a metal bushing therein that rotatably receives and bears against the spindle during spinning movement.

12. A pyrotechnic entertainment product as claimed in claim 1, said spinning device being rotatably mounted on said upper end of the spindle above the head of the creature.

13. A pyrotechnic entertainment product as claimed in claim 1, said pyrotechnic thruster comprising an ignitable engine with a fuse.

14. A pyrotechnic entertainment product comprising:

a spindle adapted to be disposed in an uptight condition during use and having an upper end and a lower end;

an article secured to the spindle between said ends and having an image thereon of a live creature, said creature having a head generally adjacent to but spaced below said upper end of the spindle; and a spinning device that is configured to resemble a hat with a brim which is rotatably mounted on the spindle, said spinning device including means for propelling the brim of the device in a spinning motion on the spindle whereby to produce the visual effect that the hat of the creature is spinning while the creature remains stationary.

15. A pyrotechnic entertainment product comprising:

a spindle adapted to be disposed in an upright condition during use and having an upper end and a lower end;

an article secured to the spindle between said ends and having an image thereon of a live creature, said creature having a head generally adjacent to but spaced below said upper end of the spindle; and a spinning device that is configured to resemble a hat and is rotatably mounted on the spindle, said spinning device including an ignitable engine disposed to propel the device in a spinning motion on the spindle after the engine is ignited whereby to produce the visual effect that the hat of the creature is spinning while the creature remains stationary, said device including a generally flat, circular panel resembling the brim of a hat, and a centrally disposed dome projecting upwardly from one side of the panel resembling the crown of a hat, said panel having all opening that rotatably receives the upper end of the spindle.

* * * * *